US007145546B2

(12) United States Patent
Kang et al.

(10) Patent No.: US 7,145,546 B2
(45) Date of Patent: Dec. 5, 2006

(54) APPARATUS OF DRIVING LIGHT SOURCE FOR DISPLAY DEVICE

(75) Inventors: Moon-Shik Kang, Seongnam (KR); Inn-Sung Lee, Suwon (KR); Song-Yi Han, Yongin (KR)

(73) Assignee: Samsung Electronics Co., Ltd. (KR)

( * ) Notice: Subject to any disclaimer, the term of this patent is extended or adjusted under 35 U.S.C. 154(b) by 303 days.

(21) Appl. No.: 10/606,015

(22) Filed: Jun. 24, 2003

(65) Prior Publication Data

US 2004/0004596 A1 Jan. 8, 2004

(30) Foreign Application Priority Data

Jun. 25, 2002 (KR) ..... 10-2002-0035753

(51) Int. Cl.
*G09G 3/36* (2006.01)

(52) U.S. Cl. ..... 345/102; 345/87; 345/90; 345/91; 345/98

(58) Field of Classification Search ..... 345/87–95, 345/102–104, 204–214; 315/157, 247–248, 315/276, 219; 363/133–135
See application file for complete search history.

(56) References Cited

U.S. PATENT DOCUMENTS

| | | | | |
|---|---|---|---|---|
| 5,027,034 | A * | 6/1991 | Ruby et al. | 315/106 |
| 6,317,347 | B1 * | 11/2001 | Weng | 363/134 |
| 6,388,388 | B1 * | 5/2002 | Weindorf et al. | 315/169.3 |
| 6,690,121 | B1 * | 2/2004 | Weindorf | 315/247 |
| 6,812,916 | B1 * | 11/2004 | Hwang | 345/102 |
| 2002/0003525 | A1 | 1/2002 | Hwang | 345/102 |

* cited by examiner

*Primary Examiner*—Vijay Shankar
(74) *Attorney, Agent, or Firm*—Cantor Colburn LLP

(57) ABSTRACT

An apparatus of driving a light source for a display device includes a switching unit for selectively transmitting a DC input voltage, an oscillator for converting the DC input voltage into an AC voltage, and a transformer including a primary coil and a secondary coil for boosting the converted AC voltage using mutual inductance and for providing the boosted voltage for the light source. The driving apparatus further includes a current sensor for sensing a current in the oscillator or the secondary coil, and a light controller for controlling the switching unit based on the sensed current by the current sensor and a dimming control signal from an external device. Therefore, the current in the light source can be detected without a separate wire for connecting the light source and the light controller.

10 Claims, 5 Drawing Sheets

APPARATUS OF DRIVING LIGHT SOURCE FOR DISPLAY DEVICE

BACKGROUND OF THE INVENTION (a) Field of the Invention

The present invention relates to an apparatus of driving a light source for a display device.

(b) Description of the Related Art

Display devices used for monitors of computers and television sets include self-emitting displays such as light emitting diodes (LEDs), electroluminescences (ELs), vacuum fluorescent displays (VFDs), field emission displays (FEDs) and plasma panel displays (PDPs) and non-emitting displays such liquid crystal displays (LCDs) requiring light source.

An LCD includes two panels provided with field-generating electrodes and a liquid crystal (LC) layer with dielectric anisotropy interposed therebetween. The field-generating electrodes supplied with electric voltages generate electric field in the liquid crystal layer, and the transmittance of light passing through the panels varies depending on the strength of the applied field, which can be controlled by the applied voltages. Accordingly, desired images are obtained by adjusting the applied voltages.

The light may be emitted from a light source equipped in the LCD or may be natural light. When using the equipped light source, the total brightness of the LCD screen is usually adjusted by regulating the ratio of on and off times of the light source or regulating the current through the light source.

A lighting device for an LCD, i.e., a backlight unit includes a light source and an inverter for driving the light source.

The light source typically includes a fluorescent lamp and the inverter converts an input DC (direct current) voltage into an AC (alternating current) voltage and applies the AC voltage to the lamp.

The backlight unit is classified into a backlighting type and an edge lighting type depending on the packaging configuration of mounting the lamps. The backlighting type configures the lamps directly behind the panels, and normally includes several lamps.

When using several lamps, the brightness of the each lamp needs to be kept uniform, and thus the current flowing through each lamp always needs to be maintained constant. For this purpose, a current sensor for detecting the current of the lamp is installed at each lamp and the amount of the current in each lamp is controlled based on the detected current.

When feedback-controlling the operations of the lamps in independent manner, separate wires for connecting the respective lamps to the inverter are required. Accordingly, the productivity is reduced since the circuit design for an inverter may consider several wires, and the feedback-control of the lamps may become inexact due to the increased noise and interference between the wires.

For solving these problems, it is suggested that all the lamps are connected to the inverter by a single line and the control of the lamps are based on the current in the single line.

However, this method cannot separately control the lamps since the state of each lamp cannot be distinguished. For example, when one of the lamps is out of order and the current therein does not flow or decreases, it cannot be determined whether the lamp is out of order since the total current flowing through the entire lamps, which is detected to be decreased, does not tell the state of each lamp. In this case, the feedback control increases the total current in the entire lamps, and then the defected lamp, which cannot capable of performing normal lighting operations, is also supplied with current or voltage. The continuous application of the voltage to the defected lamp may result in arcs or spikes, which exerts a bad influence on the lamp and the entire backlight unit as well.

SUMMARY OF THE INVENTION

An apparatus of driving a light source for a display device is provided, which includes: an electricity supplying unit supplying electricity to the light source; a current sensor detecting a current outputted from the electricity supplying unit; and a light controller controlling the electricity supplying unit based on a signal from the current sensor and a dimming control signal from an external device.

The electricity supplying unit preferably includes a transformer including a primary coil and a secondary coil and applying a voltage induced in the secondary coil to the light source. The electricity supplying unit may further includes a switching unit switching an input voltage from an external device under the control of the light controller, and an oscillator generating an AC voltage based on the input voltage from the switching unit and supplies the generated AC voltage to the primary coil of the transformer.

The current sensor senses a current related to the primary coil of the transformer, and in particular, a current in the oscillator. Alternatively, the current sensor is connected to the secondary coil of the transformer and senses a current in the secondary coil of the transformer.

The light controller controls the switching unit preferably in a pulse width modulation manner based on the dimming control signal and the signal from the current sensor.

Preferably, the light controller determines an overcurrent in the light source on the basis of the signal from the current sensor and turns on/off the switching unit based on the determination of the overcurrent.

According to an embodiment of the present invention, the current sensor comprises a capacitor and a diode connected in parallel between the electricity supplying unit and a predetermined voltage and a voltage divider connected to the capacitor and the diode and to and the light controller.

The light source may include a fluorescent lamp.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figure 1:
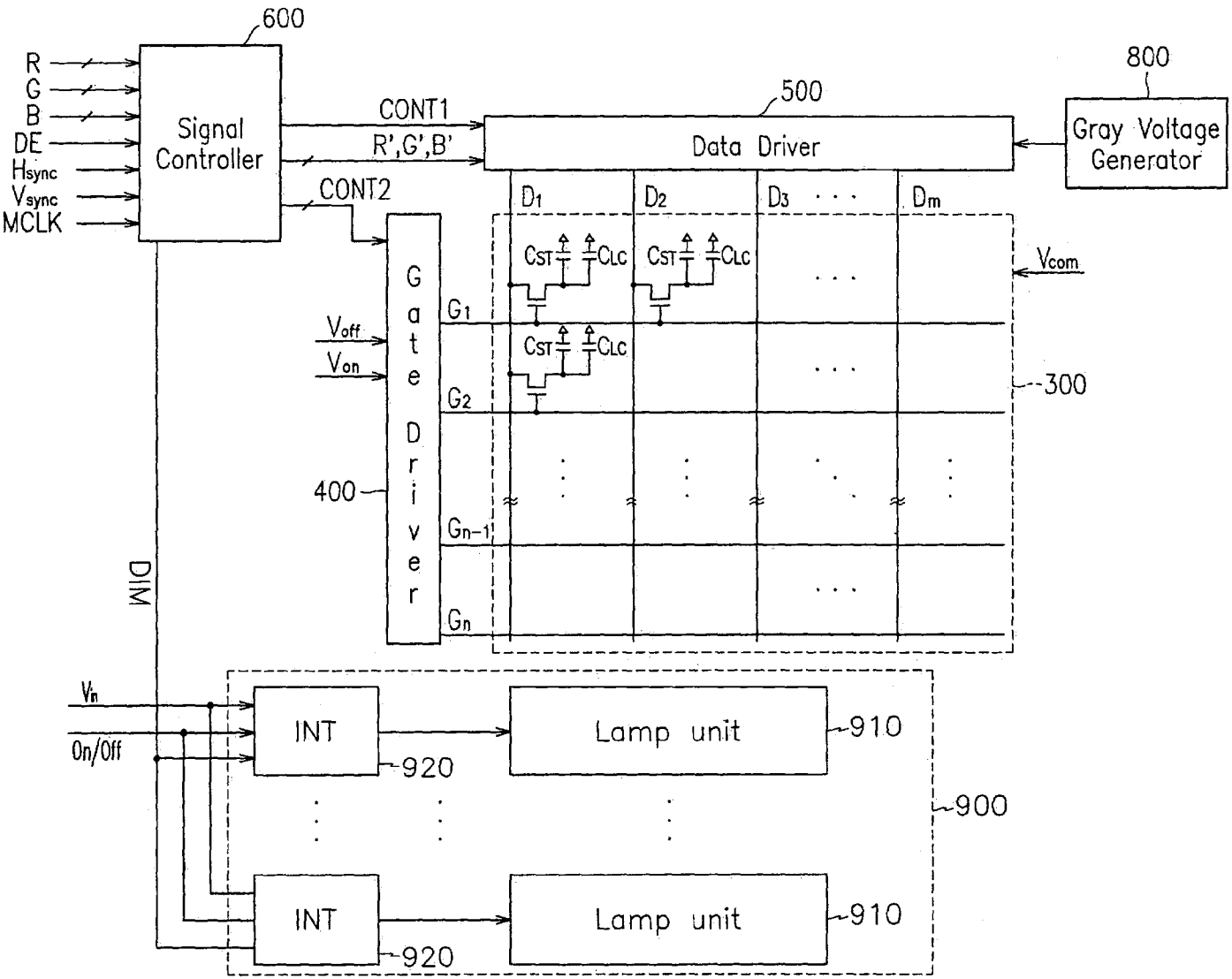
FIG. 1 is a block diagram of an LCD according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein.

In the drawings, the thickness of layers and regions are exaggerated for clarity. Like numerals refer to like elements throughout. It will be understood that when an element such as a layer, film, region, substrate or panel is referred to as being "on" another element, it can be directly on the other element or intervening elements may also be present. In contrast, when an element is referred to as being "directly on" another element, there are no intervening elements present.

Figure 2:
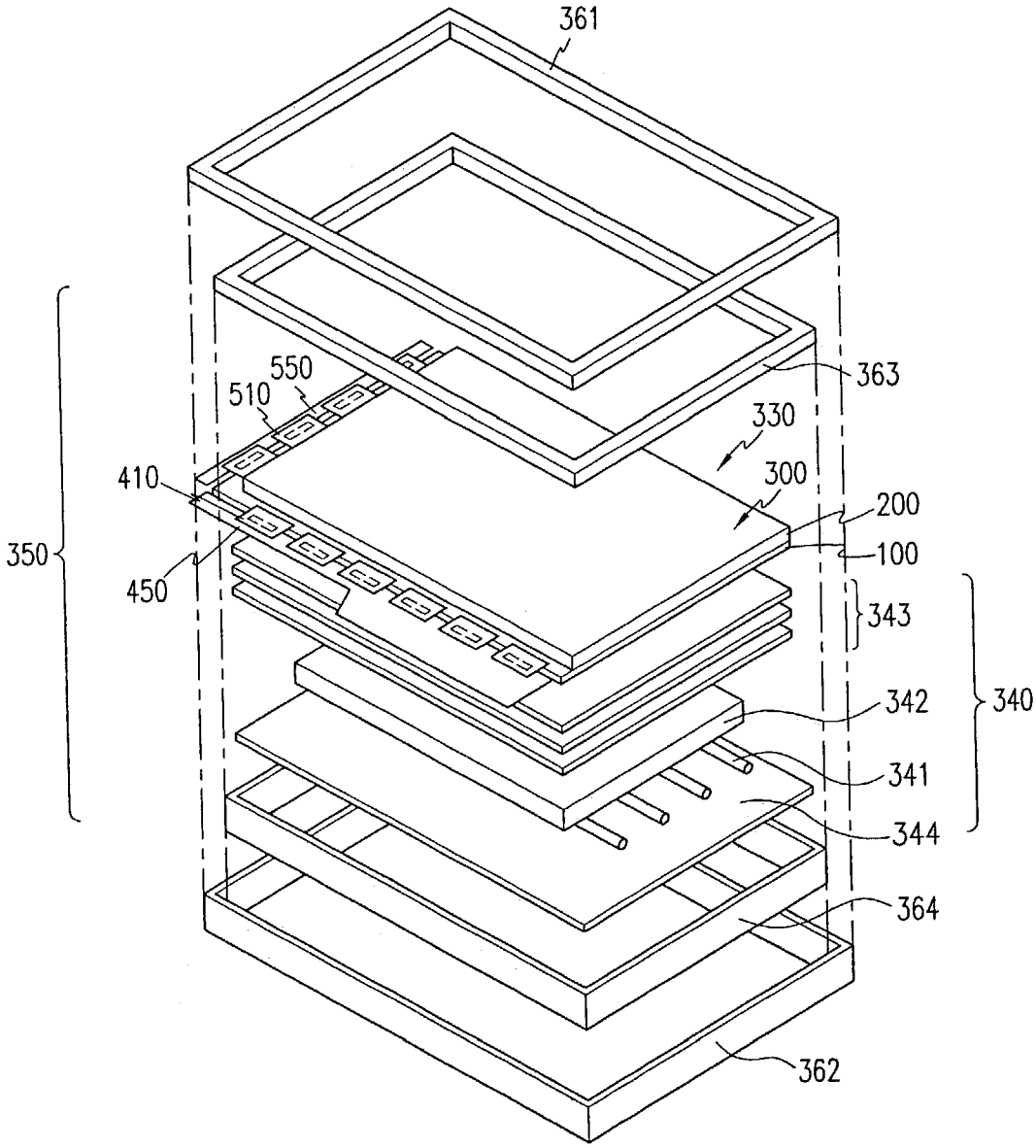
FIG. 2 is an exploded perspective view of an LCD according to an embodiment of the present invention.
Figure 3:
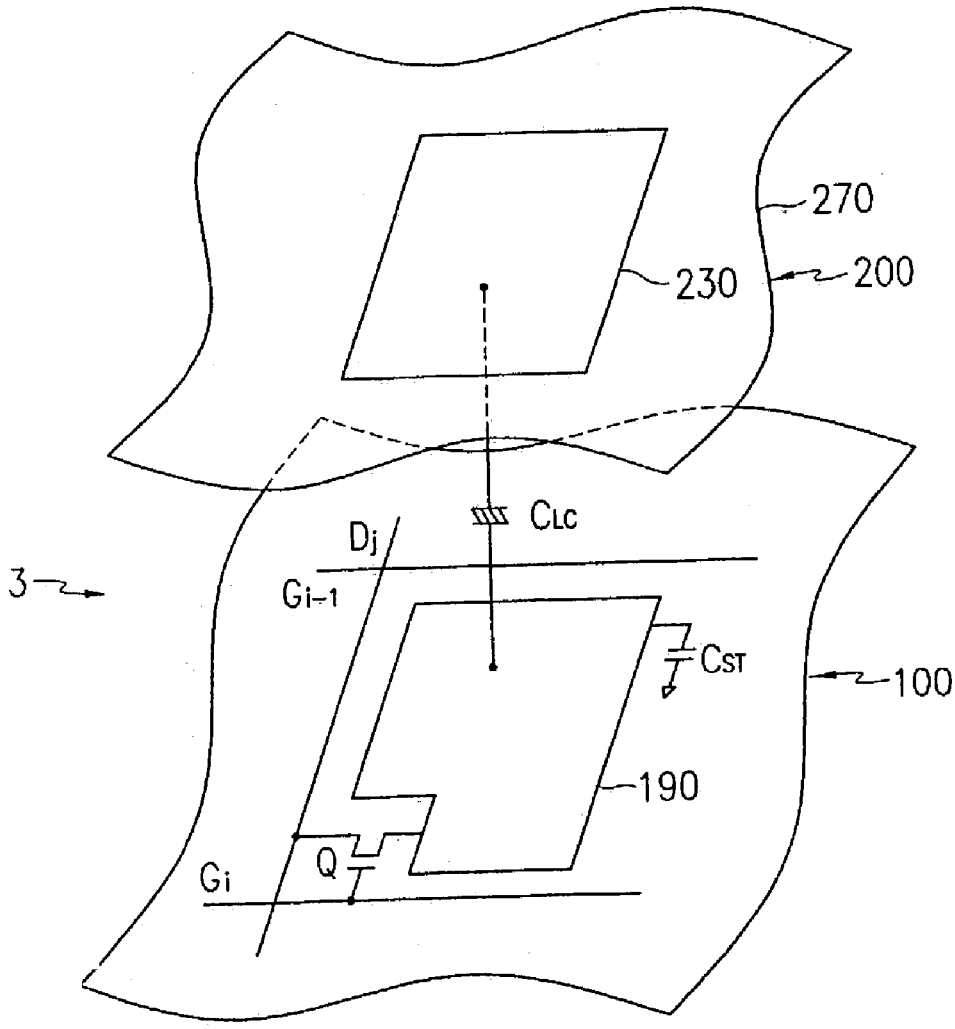
FIG. 3 is an equivalent circuit diagram of a pixel of an LCD according to an embodiment of the present invention.

Then, apparatus of driving a light source for a liquid crystal display according to embodiments of the present invention will be described with reference to the drawings FIG. 1 is a block diagram of an LCD according to an embodiment of the present invention, FIG. 2 is an exploded perspective view of an LCD according to an embodiment of the present invention, and FIG. 3 is an equivalent circuit diagram of a pixel of an LCD according to an embodiment of the present invention.

Referring to FIG. 1, an LCD according to an embodiment of the present invention includes a LC panel assembly 300, and a gate driver 400 and a data driver 500 connected thereto, a gray voltage generator 800 connected to the data driver 500, a lighting unit 900 for illuminating the LC panel assembly 300, and a signal controller 600 controlling the above-described elements.

In structural view, the LCD according to an embodiment of the present invention includes a LC module 350 including a display unit 330 and a backlight unit 340, and a pair of front and rear cases 361 and 362, a chassis 363, and a mold frame 364 for containing and fixing the LC module 350 as shown in FIG. 2.

The display unit 330 includes the LC panel assembly 300, a plurality of gate flexible printed circuit (FPC) films 410 and a plurality of data FPC films 510 attached to the LC panel assembly 300, and a gate printed circuit board (PCB) 450 and a data PCB 550 attached to the associated FPC films 410 and 510, respectively.

The LC panel assembly 300, in structural view shown in FIGS. 2 and 3, includes a lower panel 100, an upper panel 200 and a liquid crystal layer 3 interposed therebetween while it includes a plurality of display signal lines $G_1$–$G_n$ and $D_1$–$D_m$ and a plurality of pixels connected thereto and arranged substantially in a matrix in circuital view shown in FIGS. 1 and 3.

The display signal lines $G_1$–$G_n$ and $D_1$–$D_m$ are provided on the lower panel 100 and include a plurality of gate lines $G_1$–$G_n$ transmitting gate signals (called scanning signals) and a plurality of data lines $D_1$–$D_m$ transmitting data signals. The gate lines $G_1$–$G_n$ extend substantially in a row direction and are substantially parallel to each other, while the data lines $D_1$–$D_m$ extend substantially in a column direction and are substantially parallel to each other.

Each pixel includes a switching element Q connected to the display signal lines $G_1$–$G_n$ and $D_1$–$D_m$, and an LC capacitor $C_{LC}$ and a storage capacitor $C_{ST}$ that are connected to the switching element Q. The storage capacitor $C_{ST}$ may be omitted if unnecessary.

The switching element Q such as a TFT is provided on the lower panel 100 and has three terminals: a control terminal connected to one of the gate lines $G_1$–$G_n$; an input terminal connected to one of the data lines $D_1$–$D_m$; and an output terminal connected to the LC capacitor $C_{LC}$ and the storage capacitor $C_{ST}$.

The LC capacitor $C_{LC}$ includes a pixel electrode 190 on the lower panel 100, a common electrode 270 on the upper panel 200, and the LC layer 3 as a dielectric between the electrodes 190 and 270. The pixel electrode 190 is connected to the switching element Q, and the common electrode 270 covers the entire surface of the upper panel 100 and is supplied with a common voltage Vcom. Alternatively; both the pixel electrode 190 and the common electrode 270, which have shapes of bars or stripes, are provided on the lower panel 100.

The storage capacitor $C_{ST}$ is an auxiliary capacitor for the LC capacitor $C_{LC}$. The storage capacitor $C_{ST}$ includes the pixel electrode 190 and a separate signal line (not shown), which is provided on the lower panel 100, overlaps the pixel electrode 190 via an insulator, and is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 via an insulator.

For color display, each pixel uniquely represents one of three primary colors such as red, green and blue colors or sequentially represents the three primary colors in time, thereby obtaining a desired color. FIG. 3 shows an example that each pixel includes a color filter 230 representing one of the three primary colors in an area of the upper panel 200 facing its pixel electrode 190. Alternatively, the color filter 230 is provided on or under the pixel electrode 190 on the lower panel 100.

Referring to FIG. 2, the backlight unit 340 includes a plurality of lamps 341 disposed behind the LC panel assembly 300, a light guide 342 and a plurality of optical sheets 343 disposed between the panel assembly 300 and the lamps 341 and guiding and diffusing light from the lamps 341 to the panel assembly 300, and a reflector 344 disposed under the lamps 341 and reflecting the light from the lamps 341 toward the panel assembly 300.

The lamps 341 preferably include fluorescent lamps such as CCFL (cold cathode fluorescent lamp) and EEFL (external electrode fluorescent lamp). An LED is another example of the lamp 341.

Referring to FIG. 1, the lighting unit 900 includes a plurality of lamp units 910 corresponding to the lamps 341 shown in FIG. 2 and a plurality of inverters 920 connected to the respective lamp units 910. The inverter 920 initiates the lamp units 910 and dimming the lamp units 910 by controlling the duty ratio of the on time and the off time of the lamp units 910. The inverters 920 are provided on either separate PCBs called inverter PCBs, or the gate PCB 450 or the data PCB 550. The detailed configuration of the inverters 920 are described later in detail.

A pair of polarizers (not shown) polarizing the light from the lamps 341 are attached on the outer surfaces of the panels 100 and 200 of the panel assembly 300.

Referring to FIGS. 1 and 2, the gray voltage generator 800 generates two sets of a plurality of gray voltages related to the transmittance of the pixels and is provided on the data PCB 550. The gray voltages in one set have a positive polarity with respect to the common voltage Vcom, while those in the other set have a negative polarity with respect to the common voltage Vcom.

The gate driver 400 preferably includes a plurality of integrated circuit (IC) chips mounted on the respective gate FPC films 410. The gate driver 400 is connected to the gate lines $G_1$–$G_n$ of the panel assembly 300 and synthesizes the gate-on voltage Von and the gate off voltage Voff from the driving voltage generator to generate gate signals for application to the gate lines $G_1$–$G_n$.

The data driver 500 preferably includes a plurality of IC chips mounted on the respective data FPC films 510. The data driver 500 is connected to the data lines $D_1$–$D_m$ of the panel assembly 300 and applies data voltages selected from the gray voltages supplied from the gray voltage generator 800 to the data lines $D_1$–$D_m$.

According to another embodiment of the present invention, the IC chips of the gate driver 400 and/or the data driver 500 are mounted on the lower panel 100, while one or both of the drivers 400 and 500 are incorporated along with other elements into the lower panel 100 according to still another embodiment. The gate PCB 450 and/or the gate FPC films 410 may be omitted in both cases.

The signal controller 600 controlling the drivers 400 and 500, etc. is provided on the data PCB 550 or the gate PCB 450.

Now, the operation of the LCD will be described in detail.

The signal controller 600 is supplied with RGB image signals R, G and B and input control signals controlling the display thereof such as a vertical synchronization signal Vsync, a horizontal synchronization signal Hsync, a main clock MCLK, and a data enable signal DE, from an external graphic controller (not shown). After generating gate control signals CONT1 and data control signals CONT2 and processing the image signals R, G and B suitable for the operation of the panel assembly 300 on the basis of the input control signals, the signal controller 600 provides the gate control signals CONT1 for the gate driver 400, and the processed image signals R', G' and B' and the data control signals CONT2 for the data driver 500. In addition, the signal controller 600 generates and provides a dimming control signal DIM for the inverters 920.

The gate control signals CONT1 include a vertical synchronization start signal STV for informing of start of a frame, a gate clock signal CPV for controlling the output time of the gate-on voltage Von, and an output enable signal OE for defining the width of the gate-on voltage Von. The data control signals CONT2 include a horizontal synchronization start signal STH for informing of start of a horizontal period, a load signal LOAD or TP for instructing to apply the appropriate data voltages to the data lines $D_1$–$D_m$, an inversion control signal RVS for reversing the polarity of the data voltages (with respect to the common voltage Vcom) and a data clock signal HCLK.

The data driver 500 receives a packet of the image data R', G' and B' for a pixel row from the signal controller 600 and converts the image data R', G' and B' into the analogue data voltages selected from the gray voltages supplied from the gray voltage generator 800 in response to the data control signals CONT2 from the signal controller 600.

Responsive to the gate control signals CONT1 from the signals controller 600, the gate driver 400 applies the gate-on voltage Von to the gate line $G_1$–$G_n$, thereby turning on the switching elements Q connected thereto.

The data driver 500 applies the data voltages to the corresponding data lines $D_1$–$D_m$ for a turn-on time of the switching elements Q (which is called "one horizontal period" or "1H" and equals to one periods of the horizontal synchronization signal Hsync, the data enable signal DE, and the gate clock signal CPV). Then, the data voltages in turn are supplied to the corresponding pixels via the turned-on switching elements Q.

The difference between the data voltage and the common voltage Vcom applied to a pixel is expressed as a charged voltage of the LC capacitor $C_{LC}$, i.e., a pixel voltage. The liquid crystal molecules have orientations depending on the magnitude of the pixel voltage and the orientations determine the polarization of light passing through the LC capacitor $C_{LC}$. The polarizers convert the light polarization into the light transmittance.

By repeating this procedure, all gate lines $G_1$–$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame are reversed (which is called "line inversion"), or the polarity of the data voltages in one packet are reversed (which is called "dot inversion").

Meanwhile, the inverters 920 control the lamp units 910 in response to the dimming control signal DIM from the signal controller 550.

A detailed configuration of the inverter 920 will be described more in detail with reference to FIG. 4.

Figure 4:
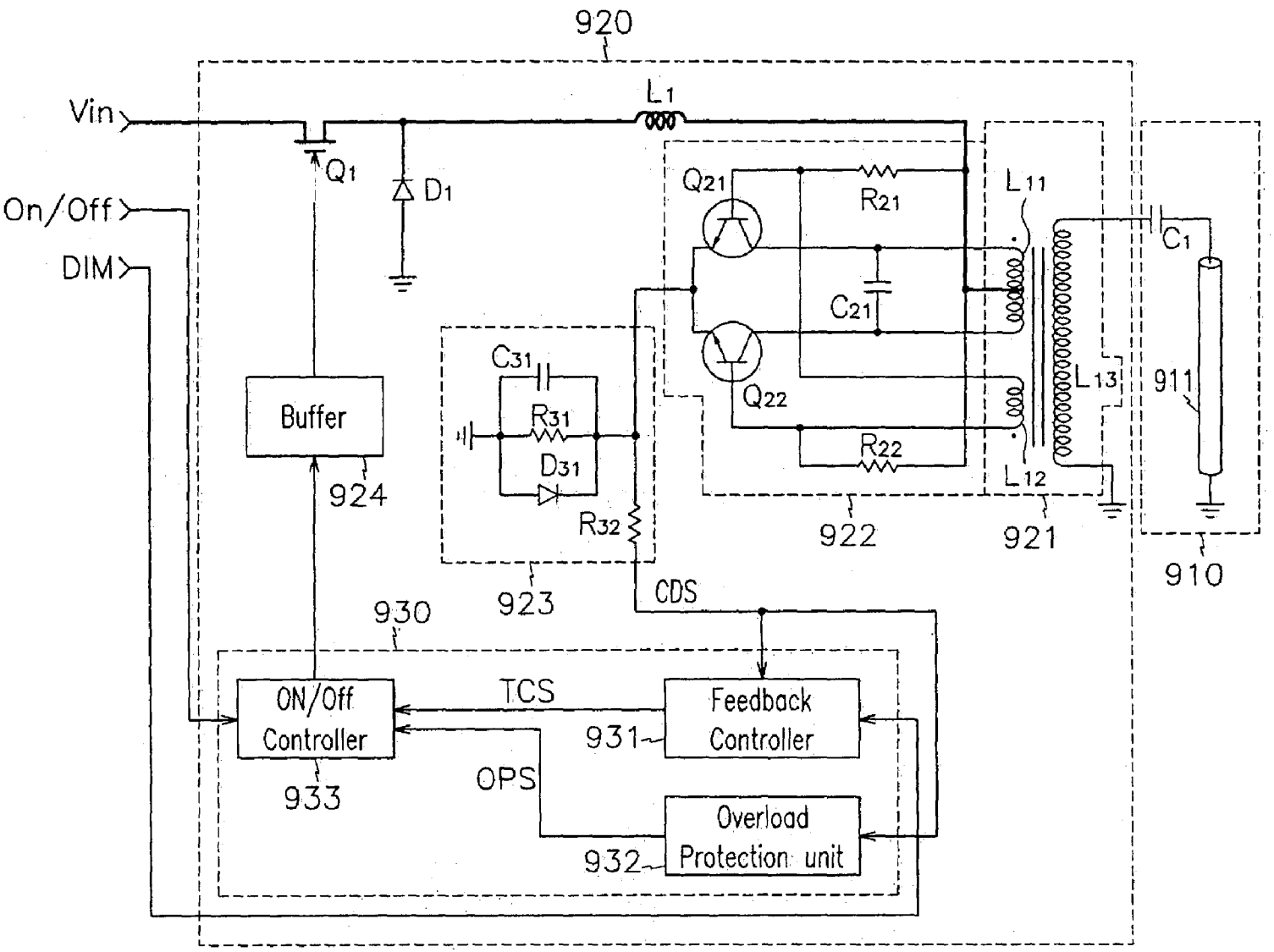
FIG. 4 is a circuit diagram of an inverter and a lamp unit according to an embodiment of the present invention.

FIG. 4 is a circuit diagram of an inverter and a lamp unit according to an embodiment of the present invention.

As shown in FIG. 4, a lamp unit 910 includes a lamp 911 and a capacitor C1 connected in series between a ground and an inverter 920 and the capacitor C1 is a ballast stabilizer.

The inverter 920 includes a transformer 921, an oscillator 922, a current sensor 923, a light controller 930, a buffer 924, a switching element Q1, a diode D1 for preventing reverse voltage, and an inductor L1.

The transformer 921 is connected to the lamp unit 910 to supply a voltage for lighting the lamp 911. The transformer 921 includes two primary coils L11 and L12 and a secondary coil L13 for generating sufficiently large voltage by mutual induction, and one end of the secondary coil L13 is connected to the capacitor C1 while the other end thereof is connected to the ground.

The oscillator 922 is connected to the primary coils L11 and L12 of the transformer 921 and supplies an AC voltage to the primary coils L11 and L12. The oscillator 922 includes a pair of transistors Q21 and Q22, a capacitor C21, and a pair of resistors R21 and R22.

Both ends of one primary coil L11 of the transformer 921 are connected to collectors of the transistors Q21 and Q22, respectively, and the capacitor C21 is connected in parallel to the primary coil L11. In addition, both ends of the other primary coil L12 are connected to bases of the transistors Q21 and Q22, respectively, and emitters of the transistors Q21 and Q22 are commonly connected to the current sensor 923. One ends of the resistors R21 and R22 are connected to the bases of the transistors Q21 and Q22, respectively, and the other ends thereof is commonly connected to an intermediate tap of the primary coil L11 of the transformer 921.

The current sensor 923 senses the current flowing through the oscillator 922 or the current flowing through the primary coil L11 and L12 of the transformer 921, and includes a filtering capacitor C31, a voltage divider including two resistors R31 and R32, and a rectifying diode D31. The capacitors C31, the resistor R31 and the diode D31 are connected in parallel between the common emitter of the transistors Q21 and Q22 and the ground. The resistor R32 is connected between the common emitter of the transistors Q21 and Q22 and the light controller 930.

The light controller 930 includes a feedback controller 931, an overload protection unit 932, and an on/off controller 933. The feedback controller 931 is connected to the current sensor 923 and is provided with the dimming control signal DIM. The overload protection unit 932 is connected to the current sensor 923. The on/off controller 933 is connected to an output terminal of the feedback controller 931 and the overload protection unit 932 and is provided with on/off voltages On/Off. The feedback controller 931 and the overload protection unit 932 may include comparators.

The switching MOS transistor Q1 and the inductor L1 are serially connected between an input voltage Vin to be inputted to the oscillator 922 and the oscillator 922, and has a gate connected to the on/off controller 933 via the buffer 924.

The diode D1 is connected in forward direction from the ground to a node the transistor Q1 and the inductor L1.

The operation of the inverter 920 having this configuration will be described in detail.

The transistor Q1 is turned on or off in response to a control signal from the buffer 924 to selectively transmit the DC input voltage Vin. The output of the transistor Q1 is supplied to the oscillator 922 via the inductor L1.

The oscillator 922 converts the DC input voltage Vin into an AC sinusoidal voltage by the alternate turn on and off of the two transistors Q21 and Q22 and supplies the generated AC voltage to the primary coils L11 and L12 of the transformer 921.

A boosted AC voltage generated in the secondary coil L13 of the transformer 921, which is induced by the current flowing in the primary coils L11 and L12, is applied to the lamp 911 via the capacitor C1 to turn on the lamp 911. The current flowing through the secondary coil L13 varies depending on the change of the current flowing in the lamp 911 due to the failure of the lamp 911, and the variation of the current in the secondary coil L13 in turn changes the currents flowing in the primary coils L11 and L12.

The sinusoidal signal generated by the oscillator 922 is also supplied to the current sensor 923. The input sinusoidal signal is filtered by the capacitor C31, half-wave rectified by the diode D31, and voltage-divided by the voltage divider R21 and R22 to be supplied to the light controller 930 as a DC current detecting signal CDS.

The feedback controller 931 and the overload protection unit 932 of the light controller 930 respectively perform their operations responsive to the current detecting signal CDS from the current sensor 923.

The feedback controller 931 supplies a control signal TCS for regulating the duty ratio of the on time and the off time of the transistor Q1 to the on/off controller 933 based on the dimming control signal DIM, and varies the control signal TCS in response to the current detecting signal CDS. The on/off controller 933 outputs the on/off voltages On/Off to the buffer 924 with the duty ratio determined by the control signal TCS from the light controller 930, thereby controlling turn-on/off of the transistor Q1.

The overload protection unit 932 enables to cut off the voltage provided for the lamp 911 to stop the lamp 911 when the lamp 911 is in an abnormal state such as current overflow. That is, the overload protection unit 932 compares the current detecting signal CDS from the current sensor 923 with a predetermined value and generates and supplies a overload control signal OPS to the on/off controller 933.

The overload control signal OPS has a predetermined level such as a low level when the current detecting signal CDS is equal to or less than the predetermined value, which indicates a normal condition, and then, the on/off controller 933 performs on/off control of the transistor Q1 based only on the control signal TCS of the feedback controller 931.

However, the overload control signal OPS becomes to have another predetermined level such as a high level when the current detecting signal CDS is higher than the predetermined value, which indicates an abnormal condition. Then, the on/off controller 933 supplies the off voltage Off to the buffer 924 to turn off the transistor Q1, thereby cut off the input voltage Vin to disable the transformer 921, thereby putting out the lamp 911 regardless of the control signal TCS from the feedback controller 931.

Figure 5:
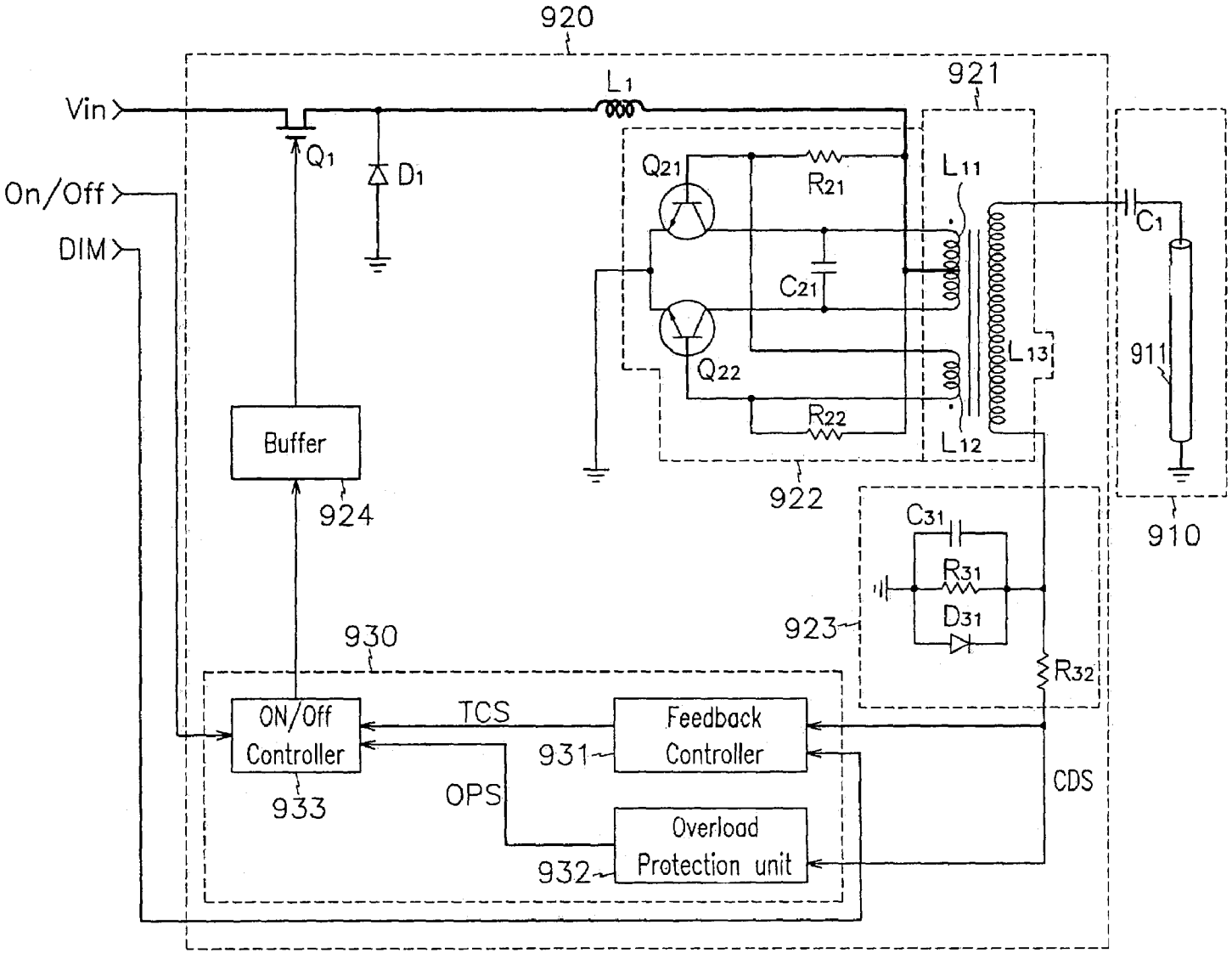
FIG. 5 is a circuit diagram of an inverter and a lamp unit according to another embodiment of the present invention.

FIG. 5 is a circuit diagram of an inverter and a lamp unit according to another embodiment of the present invention.

The configuration of an inverter 920 shown in FIG. 5 is similar to that shown in FIG. 4 except that a current sensor 923 is connected to a secondary coil L13 of the transformer 921.

In detail, as shown in FIG. 5, the current sensor 923 according to this embodiment is connected to the secondary coil L13 to feed the current in the secondary coil L13 to a light controller 930. It is noted that emitters of two transistors Q21 and Q22 of an oscillator 922 are commonly grounded.

As described above, the state of a lamp is determined by detecting the current in the lamp without separately equipping a wire connecting the lamp and an inverter. As a result, the lifetime of the lamp can be elongated by appropriate control of the lamp and the stability of the lamp is increased by blocking the voltage applied to the lamp to turn off the lamp when the lamp is in abnormal state.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. An apparatus of driving a light source for a display device, the apparatus comprising:

an electricity supplying unit supplying electricity to the light source;

a current sensor detecting a current outputted from the electricity supplying unit; and a light controller controlling the electricity supplying unit based on a signal from the current sensor and a dimming control signal from an external device;

wherein the electricity supplying unit comprises a transformer including a primary coil and a secondary coil and applies a voltage induced in the secondary coil to the light source;

wherein the electricity supplying unit further comprises:

a switching unit switching an input voltage from an external device under the control of the light controller; and an oscillator generating an AC voltage based on the input voltage from the switching unit and supplies the generated AC voltage to the primary coil of the transformer;

wherein the current sensor is connected to the oscillator and senses a current in the oscillator.

2. The apparatus of claim 1, wherein the current sensor comprises a capacitor and a diode connected in parallel between the electricity supplying unit and a predetermined voltage and a voltage divider connected to the capacitor and the diode and to the light controller.

3. The apparatus of claim 1, wherein the light source includes a fluorescent lamp.

4. The apparatus of claim 1, wherein the light controller controls the switching unit in a pulse width modulation manner based on the dimming control signal and the signal from the current sensor.

5. The apparatus of claim 1, wherein the light controller determines an overcurrent in the light source on the basis of the signal from the current sensor and turns on/off the switching unit based on the determination of the overcurrent.

6. An apparatus of driving a light source for a display device, the apparatus comprising:

an electricity supplying unit supplying electricity to the light source;

a current sensor detecting a current outputted from the electricity supplying unit; and a light controller controlling the electricity supplying unit based on a signal from the current sensor and a dimming control signal from an external device;

wherein the electricity supplying unit comprises a transformer including a primary coil and a secondary coil and applies a voltage induced in the secondary coil to the light source;

wherein the current sensor is directly connected to the secondary coil of the transformer and senses a current in the secondary coil of the transformer; and wherein the light source is directly connected to the secondary coil.

7. The apparatus of claim 6, wherein the light controller controls a switching unit in a pulse width modulation manner based on the dimming control signal and the signal from the current sensor.

8. The apparatus of claim 6, wherein the light controller determines an overcurrent in the light source based on the signal from the current sensor and turns on/off a switching unit based on the determination of the overcurrent.

9. The apparatus of claim 6, wherein the current sensor comprises a capacitor and a diode connected in parallel between the electricity supplying unit and a predetermined voltage and a voltage divider connected to the capacitor and the diode and to and the light controller.

10. The apparatus of claim 6, wherein the light source includes a fluorescent lamp.

* * * * *